US005400989A

United States Patent [19]

Gaskill

[11] Patent Number: 5,400,989

[45] Date of Patent: Mar. 28, 1995

[54] SUPPORT FOR FLEXIBLE BAG

[76] Inventor: Daniel L. Gaskill, 6711 LaSombra, Houston, Tex. 77083

[21] Appl. No.: 218,897

[22] Filed: Mar. 28, 1994

Related U.S. Application Data

[63] Continuation-in-part of Ser. No. 14,771, Feb. 8, 1993, abandoned.

[51] Int. Cl.[6] ..... B65D 5/00

[52] U.S. Cl. ..... 248/97; 248/100; 248/174; 248/152

[58] Field of Search ..... 248/97, 95, 100, 101, 248/152, 153, 145.6, 174; 220/404, 402; 383/33, 35; 141/314, 316, 390, 391

[56] References Cited

U.S. PATENT DOCUMENTS

| | | | |
|---|---|---|---|
| 1,678,521 | 7/1928 | Mitchell | 245/174 |
| 3,915,329 | 10/1975 | Zaks | 220/402 |
| 3,983,914 | 10/1976 | Benson | 141/390 |
| 4,115,909 | 9/1978 | Corella | 141/390 X |
| 4,366,916 | 1/1983 | Guido et al. | 248/97 X |
| 4,437,634 | 3/1984 | Hambleton | 248/97 |
| 4,457,483 | 7/1984 | Gagné248 | 97/ |
| 4,628,007 | 12/1986 | Ledsham | 141/390 X |
| 4,955,496 | 9/1990 | Nelson | 220/404 |
| 4,957,252 | 9/1990 | Watkins | 248/97 |
| 5,031,948 | 7/1991 | Groth et al. | 248/101 X |
| 5,056,679 | 10/1991 | Lonczak | 248/97 X |
| 5,100,087 | 3/1992 | Ashby | 248/99 X |
| 5,261,553 | 11/1993 | Mueller et al. | 248/100 X |
| 5,292,093 | 3/1994 | Shumake . | |

FOREIGN PATENT DOCUMENTS

| | | | |
|---|---|---|---|
| 0150601 | 6/1989 | Japan | 248/99 |

*Primary Examiner*—Karen J. Chotkowski
*Attorney, Agent, or Firm*—Guy McClung

[57] ABSTRACT

Apparatuses for supporting flexible bags have been developed which apparatuses have, in one aspect, a side wall member, preferably of cylindrical or conical shape, with an interlocking device including an opening in one end of the side wall member for receiving and holding an interlocking tab on the other end of the side wall member, and one or more exterior lateral projections or anchors for holding a portion of the bag. In one aspect a portion of a bag supported within an upright structure formed with the support has a portion looped under the interlocking tab exteriorly of the upright structure.

12 Claims, 4 Drawing Sheets

FIG. 11
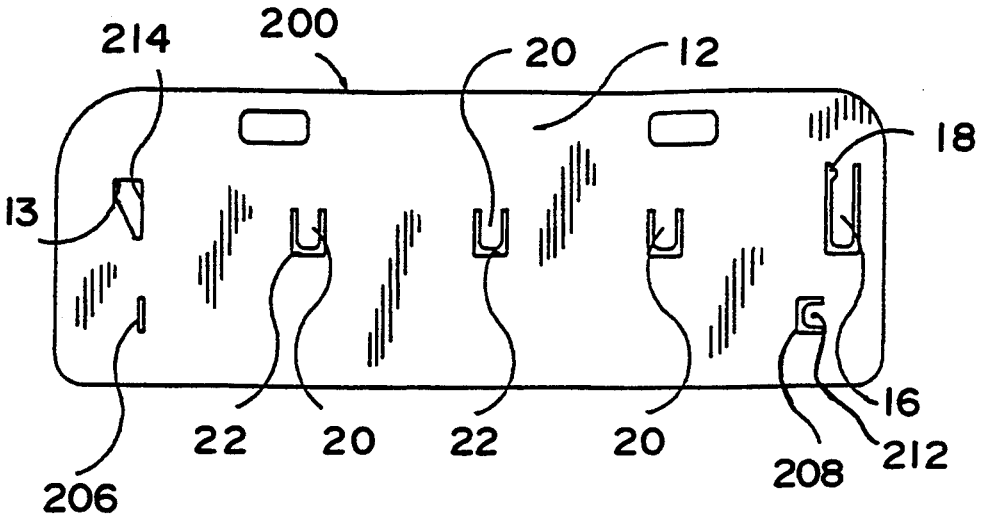
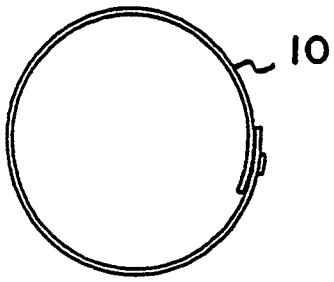
FIG. 12
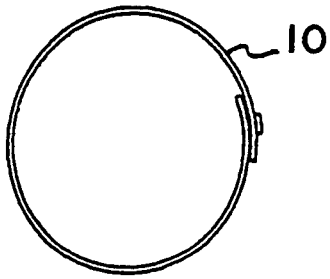
FIG. 13
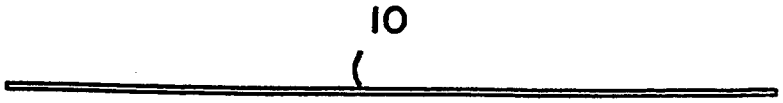
FIG. 14
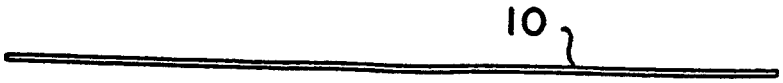
FIG. 15
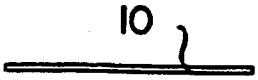
FIG. 16
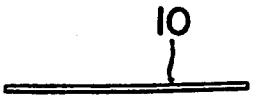
FIG. 17

SUPPORT FOR FLEXIBLE BAG

RELATED APPLICATION

This is a continuation-in-part of U.S. application Ser. No. 08/014,771, filed on Feb. 8, 1993, and now abandoned with the same title.

BACKGROUND OF THE INVENTION

1. Field Of The Invention

This invention relates to flexible supports for bags and, in one aspect to such a support which is interlockable, collapsible, and has one or more tabs about which a portion of a bag, e.g. a handle or a tie-string, can be emplaced.

2. Description Of Related Art

The present inventor is aware of the use of a can, e.g. a garbage can, as a support for a flexible bag; for example, such a bag is positioned within a garbage can with a portion of the bag wrapped over the top edge of the garbage can. The present inventor is aware of so-called "T-shirt bags" which have two open portions formed integrally of a flexible bag so that handles are formed near the top of the bag. Such bags are usually made from a very flexible plastic and are dispensed from a wire rack or frame holding several of the bags with each bag's handles mounted on wire or rod holders forming part of the rack or frame.

U.S. Pat. No. 5,169,025 discloses a single piece thermal insulating sheath with one or more tabs and interengaging button snaps so that the sheath can be fastened around a beverage container.

U.S. Pat. No. 5,143,242 discloses a paint bucket with a flexible liner.

U.S. Pat. No. 5,105,969 discloses a container for facilitating secondary use of plastic bags with a pair of opposed upper integral strap carrying handles, the container having opposed supports for receiving the bag handles, each support including a hinged flap. Hook-and-loop fasteners hold the flaps down.

U.S. Pat. No. 4,457,483 discloses a collapsible support for a garbage bag that has a one piece flexible sheet blank with fastening means to form the sheet into a retaining structure and with openings through which a portion of a bag is insertable and in which it is held.

There has long been a need for a handy simple support for T-shirt bags and other bags with handles or tie-strings which serve as handles. There has long been a need for such a support which can be stored and erected with little trouble. There has long been a need for such a support which can be manufactured from inexpensive materials and which can be made easily.

SUMMARY OF THE PRESENT INVENTION

The present invention discloses, in one embodiment, a flexible support for a bag, the support including a flexible sheet of material, e.g. but not limited to cardboard, rigid paper, or firm plastic, which has an interlock comprising an opening at one end of the sheet and a tab at the other end, the tab insertable into the opening when the sheet is folded on itself; the sheet forming a cone or cylinder once it is folded on itself; and one or more side anchors extending down into lateral openings on the flexible sheet, the anchors disposed so that a bag placed in the cone or cylinder formed by the sheet may have its handles, placed about the anchors so that the bag does not collapse within the support and the bag is held open within the support. For T-shirt bags two side anchors are preferable, one for each of the two bag handles common to T-shirt bags.

In another aspect a support according to the present invention has a plurality of the side anchors and a bag, whether or not it has handles or a drawstring, is placed in the support and a top edge of the bag is emplaced under each of one or more side anchors to hold the bag open in place in the support without collapsing therein.

In another embodiment of a support according to this invention the support has a lid, a bottom, or both which can be attached to or formed integrally of the flexible sheet. Pop-on lids and bottoms may be used.

In another aspect the present invention discloses a rigid bag support of cylindrical or conical shape formed either from a solid piece of material, e.g. but not limited to glass, metal or rigid plastic, or with a wire, rod, or tubular framework. Side anchor tabs, as described above can be used or projections or knobs are employed about which a bag portion, handle or string can be placed and held. The support can have vertical walls or walls that flare out providing a broader base than a top.

Supports according to this invention may have one or more exterior suction cups thereon, hooks or handles for mounting the support or securing it to another member (e.g. part of an automobile or an inside wall of a refrigerator or portable cooler) or hanging it therefrom. In another aspect belt loop holes are provided in the cone or cylinder so that a belt can be used with the device to provide a carrying handle or for attachment to another member such as a pole or rod. In one embodiment an interlocking tab can also serve as a side anchor for holding part of a bag.

Devices according to this invention may have one or more bags mounted thereon for inserting items into an exposed open bag or the devices may be used for easily dispensing such bags for use elsewhere. It is most preferred that certain apparatuses according to this invention have a height equal to about three-fourths of the height of a bag to be supported so the bag can rest on the ground or a support base or bottom and so there is some slack in the bag to facilitate unloading.

It is, therefore, an object of at least certain preferred embodiments of the present invention to provide:

- New, useful, unique, efficient, and effective devices for supporting a bag, including but not limited to bags with handles or drawstrings;
- Such devices for holding bags open in a non-collapsed state for insertion of items therein or for easily dispensing bags for use elsewhere;
- Such devices which in one preferred embodiment form or are formable into a cone with a wide base that provides stability;
- Such devices with a top, a bottom, or both which, in one aspect are attached to or formed of a flexible sheet; and which in another aspect are removably attachable to such a sheet;
- Such devices having one or more side anchors cut out from or formed integrally of a side wall of the device, projecting inwardly, outwardly or flush with the side wall, and about which a portion of a bag is removably attachable to facilitate holding the bag open on the support without collapsing therein;
- Such devices having a plurality of tabs or projections therearound for holding a portion of a bag whether or not the bag has a handle or a drawstring; and Such devices which, in one aspect are formed from a solid relatively inflexible member or with a framework made from tubes, rods or the like.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions of further improvements.

DESCRIPTIONS OF THE DRAWINGS

So that the manner in which the above-recited features, advantages and objects of the invention, as well as others which will become clear, are attained and can be understood in detail, more particular description of the invention briefly summarized above may be had by reference to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective equivalent embodiments. It is to be understood that features shown for one embodiment may be incorporated into another embodiment.

FIG. 11 is a plan view of a support according to the present invention.

FIG. 12 is a top view of the support of FIG. 2.

FIG. 13 is a bottom view of the support of FIG. 2.

FIG. 14 is a side view of the support of FIG. 2.

FIG. 15 is a view of a side of the support of FIG. 2 opposite the side shown in FIG. 14.

FIG. 16 is a left end view of the support of FIG. 2.

FIG. 17 is a right end view of the support of FIG. 2.

DESCRIPTION OF EMBODIMENTS PREFERRED AT THE TIME OF FILING FOR THIS PATENT

Figure 1:
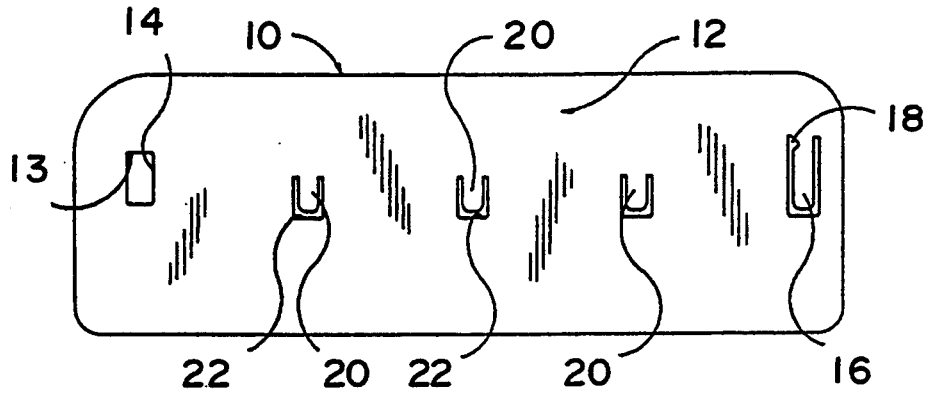
FIG. 1 is a plan view of a support according to the present invention.

Referring now to FIG. 1, a device according to this invention has a flexible sheet member 12 with end interlocking apparatus including an end opening 14 and an interlocking tab 16. Part of the side wall 13 which defines the opening 14 is received in an indentation 18 in the tab 16 and provides a more secure holding of the tab 16 in place in the opening 14. One or more holding anchors 20 (three shown in FIG. 1) are formed of or cut from the sheet 12 for holding a portion of a flexible bag, a handle of such a bag, or a part of a tie-string or drawstring of such a bag. The tab 16 may also serve as a holding anchor. Recesses 22 around the anchors 20 are preferably sized to facilitate emplacement of a part of a bag around the anchors. Although one end interlocking apparatus is shown, it is within the scope of this invention to use two or more. They can be aligned vertically or horizontally or randomly spaced apart on the sheet. By configuring the sheet member 12, e.g. as a trapezoid, a conical structure can be formed with a base broader than a top thereof for added stability.

Figure 2:
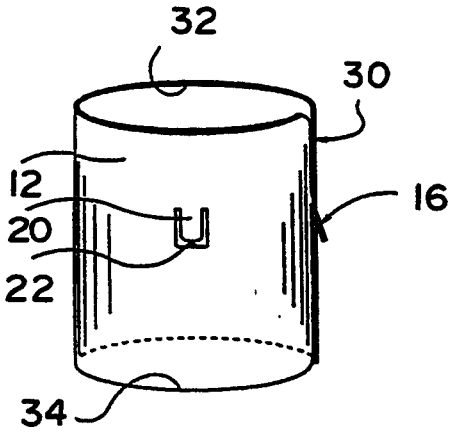
FIG. 2 is a perspective view of the support of FIG. 1 with its ends interlocked together.

As shown in FIG. 2 when the tab 16 interlocks with the opening 14, a cylindrical bag support 30 is formed with an open top 32 and an open bottom 34. A flexible bag is emplaceable within the support 30 with portions of the bag tucked under the three anchors 20 and the tab 16 to hold the bag in a non-collapsed open disposition within and covering the top of the supports 30. For use with a T-shirt bag having two handle portions formed therein, each handle can be hooked over one of the anchors 20, preferably over two diametrically opposed anchors 20 or over the tab 16 and an anchor 20 diametrically opposed to the tab 16. The sheet 12 can be sized and configured to correspond to a flexible bag of any size and shape. Exposed portions of a bag tie-string or drawstring can be looped under anchors 20 and the tab 16 in a manner similar to the way in which handles of a T-shirt bag are secured about the anchors. For a relatively stable mounting of a bag with equispaced handles or drawstring portions, it is preferred that a support device according to this invention have a plurality of equispaced anchors or projections which correspond in spacing to the particular type bag to be supported.

Figure 3:
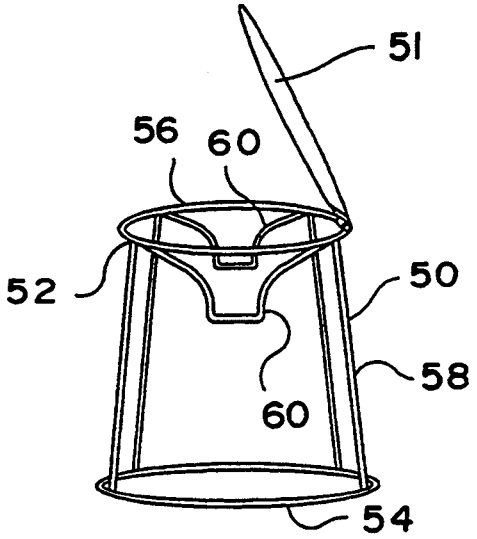
FIG. 3 is a perspective view of a support according to the present invention.

A bag support 50 according to the present invention as shown in FIG. 3 has a wire or tubular frame 52 (made e.g. from wire, wire-like material, rod, rod-like material, or tubular material which is solid or hollow) with a bottom ring 54, a top ring 56 and side braces 58 between the two rings. One or more projections 60 extend from the top ring 56 for emplacement thereabout of a portion of a flexible bag to be supported within the frame 52. A movable top cover 51 secured to the frame is movable to close off an open bag.

Figure 4:
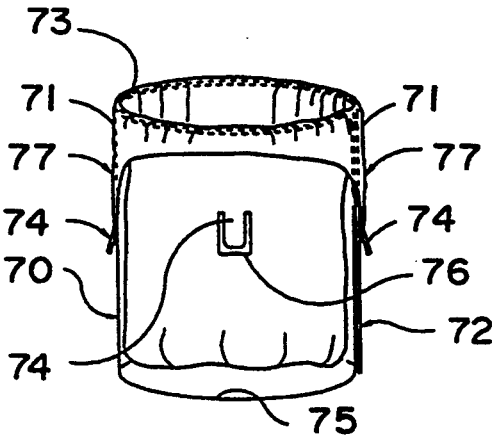
FIG. 4 is a perspective view of a support according to the present invention.

FIG. 4 illustrates a bag support 70 according to this invention which has a rigid or solid side member 72 with at least one side anchor 74 (three shown) formed therein or secured thereto in a recess 76. The support 70 has an open top end 73 and an open bottom end 75. A bag 71 has each of its two handles 77 looped under one of the anchors 74.

Figure 5:
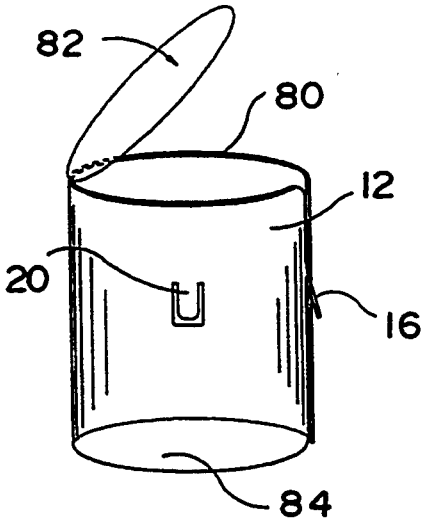
FIG. 5 is a perspective view of a support with a top and a bottom as shown in plan view in FIG. 8.
Figure 8:
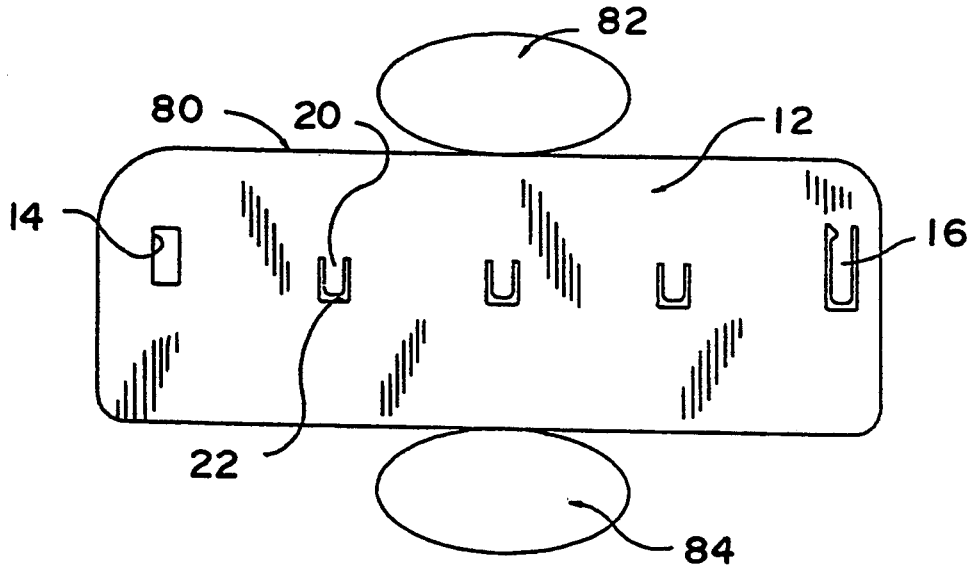
FIG. 8 is a plan view of a support according to the present invention.

In a device 80 according to this invention as shown in FIGS. 5 and 8, numerals as in FIG. 1 indicate similar items. The device 80 for supporting a flexible bag also has a solid top 82 which can be either rigid, semi-flexible, or flexible material which is formed integrally of the sheet 12 or secured thereto. Similarly the device 80 has a solid bottom 84. Upon folding of the sheet 12 on itself and interlocking of the tab 16 in the opening 14 the device 80 has the form shown in FIG. 5 when the top 82 is folded over the top end of the device 80. Thus a bag supported by the device can have material or items inserted into it and then the top 82 can be moved to close off the top of the bag.

Figure 6:
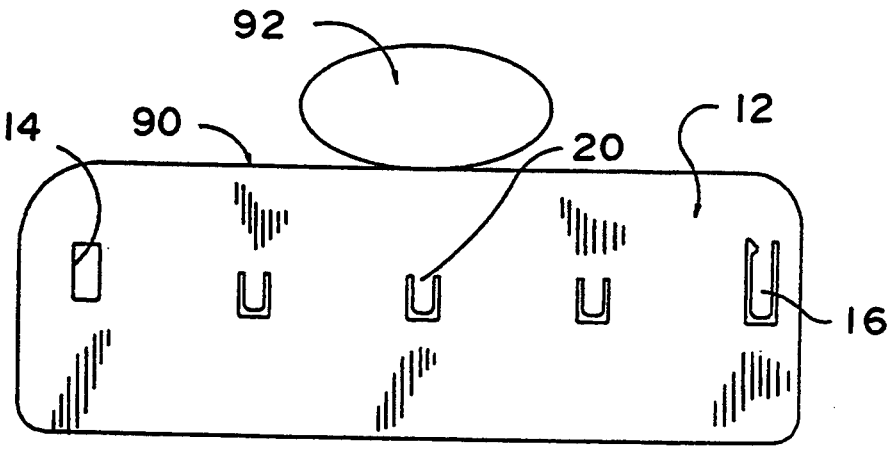
FIG. 6 is a plan view of a support according to the present invention.

FIG. 6 illustrates a device 90 according to the present invention having a top 92 (like the top 82, FIG. 8), with other numerals indicating parts similar to the device of FIG. 1.

Figure 7:
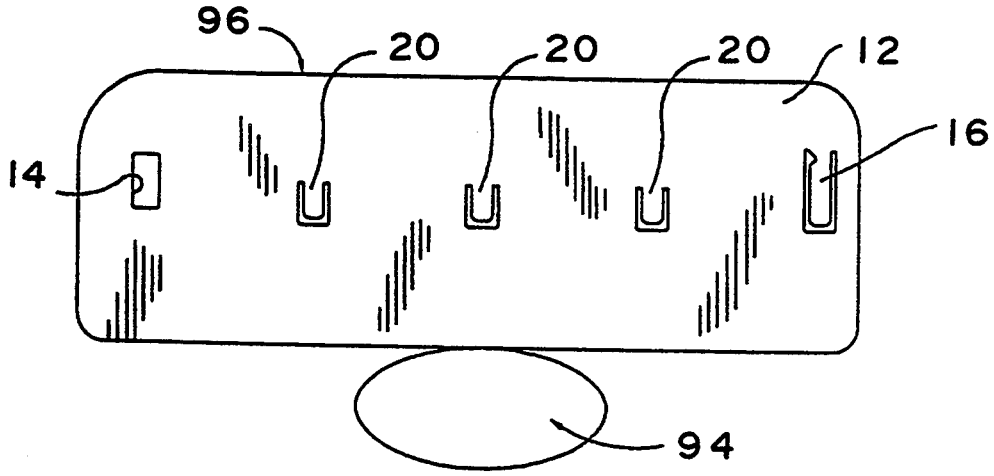
FIG. 7 is a plan view of a support according to the present invention.

FIG. 7 illustrates a device 96 with a bottom 94 (like the bottom 84, FIG. 8), with other numerals indicating parts similar to the device of FIG. 1

Figure 9:
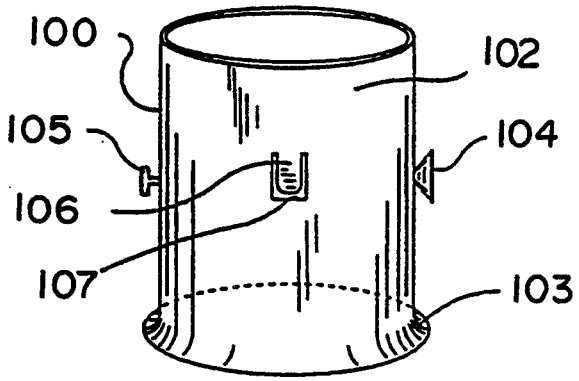
FIG. 9 is a perspective view of a support according to the present invention.

As shown in FIG. 9 a support 100 according to this invention has a cylindrical side member 102 with a base 103 which flares out from the bottom of the side member. A suction cup 104 secured to the side member 102 allows the support 100 to be attached to any suitable member or object, e.g. a window pane or wall. A portion of a bag or a bag handle can be looped around a projection 105 extending from the side member 102. Also, such a portion or handle can be held by a side anchor 106 in a recess 107 in the side member 102. One or more projections 105 may be provided located as desired on the side member 102.

Figure 10:
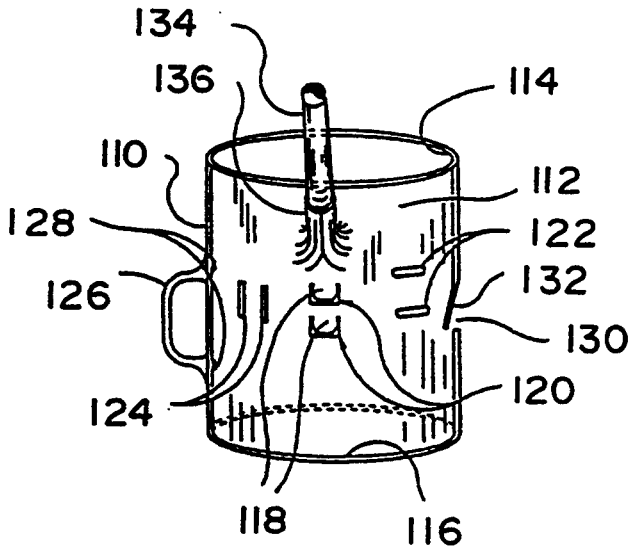
FIG. 10 is a perspective view of a support according to the present invention.

A device 110 according to the present invention as shown in FIG. 10 has a side wall member 112, an open top 114, and an open bottom 116. One or more side anchors 118 in recess openings 120 provide a holder for holding a portion of a bag disposed within the device 110. Slots 122 provide openings into which are insertable protrusions of a handle 126, e.g. protrusions 128. Alternatively, the handle 126 may be formed integrally of the wall member. One or more openings 130 and tabs 132 provide an alternate securement for a portion of a bag. Preferably, the protrusions 128 as shown have upwardly angled ends to facilitate lifting the device. A removable handle 134 is held in a socket 136 formed integrally of or attached to the side wall member 112. Slots 124 may serve as openings through which a belt or strap may pass.

Using a device according to this invention can assist in the sanitary disposal of animal feces and make possible the utilization and re-use of common bags including but not limited to plastic T-Shirt bags used by many businesses. The device holds the T-shirt bag in an open distributed position to allow waste to be inserted. The support is loaded with a plastic bag, then placed in a strategic location while picking up dog feces or cat litter box waste. The configuration described allows for depositing waste material into a bag while keeping the apparatus sanitary.

In use, the T-Shirt bag is first placed inside the cylinder and the bag handles are pulled up and over the top of the device and fastened by wrapping them around the side anchors which are located in such a way that the bag still covers the top of the support. By simply pulling down on the plastic bag handles, the bag is released from the anchors. The bag can then be lifted, held up by the handles and spun until the upper portion of the bag is securely closed or tied in a knot or securely closed by using a wire-type tie which will eliminate odors until disposal, while at the same time keeping flies and insects from getting into the bag. Thus a normally messy and unpleasant job is easily handled and disposed of in a sanitary manner. This will encourage a person to cleanup animal waste every few days which will help to reduce the chances of fly and insect infestation and promote a healthier environment for pets, owners, and neighbors.

A support according to this invention with a flexible bag therein provides a container for use with disposable diapers, medical waste or any similar item which requires sanitary disposal. It provides an ideal receptacle for a firetruck or an ambulance for soiled bandages or other small items which need to be disposed of in a sanitary manner.

FIG. 11 shows a device 200 according to the present invention in which numerals identical to numerals in FIG. 1 indicate identical structural elements. An end opening 214 differs in shape from the end opening 14 of the device 10 of FIG. 1; and a horizontal tab 212 in a recess 208 of the flexible sheet member is configured and disposed to latch into a latch opening 206. In combination with the vertically extending interlocking tab 16, use of the horizontal tab 212 provides stability to the device 200 both in a Y-axis orientation (vertically) and in an X-axis orientation (horizontally). It is within the scope of this invention to interconnect two or more of the devices 200 (or two or more of the devices 10) end to end to form a larger wall, support or enclosure. Use of the dual tabs (16 and 212) provides increased stability when two or more devices are interconnected. Such interconnection can effect one long piece (e.g. for a wall, divider, barrier) whose distal ends are not interconnected or a larger cylindrical support whose distal ends are interconnected (e.g. for a children's play enclosure, duck blind, etc.).

FIGS. 1, 2, and 12–17 disclose one design of a bag support according to the present invention. FIGS. 14–17 are also accurate views of the design of the device 200. Adding the tab 212 to FIGS. 12 and 13 renders them accurate views of the design 200.

Embodiments of this invention (e.g. the devices of FIGS. 1, 6, 7, 8, and 11) provide an exterior bag support with an interlocking tab 16 which holds two ends of the support together and also, in an assembled device, projects outwardly from and is exposed exteriorly of the device so that a portion of a bag may be looped and anchored around and under the tab to removably secure the bag in place within the support. With the bag portion looped under the tab, the tab is exposed exteriorly of the support and projects outwardly therefrom so that the bag does not cover or conceal the tab and the bag portion (e.g. a bag handle) is easily releasable from the tab exteriorly of the support; i.e., the anchored bag portion is on the outside of the support and not down within the support or bag. This arrangement also permits looping of a bag portion around the tab without moving the tab; i.e., the tab 16 does not move when the device is assembled and does not need to move to loop the bag portion around the tab or to remove the bag portion from under the tab. It is also within the scope of this invention for one or more bag anchors to be used in addition to the inter locking tab. The anchor(s) is flush with the sheet member; or in other embodiments the anchor(s) projects outwardly from an upright structure formed with the sheet member. Also the anchor(s) may be disposed and configured for looping thereunder of a bag portion exteriorly of the upright structure without the need to move the anchor(s) to effect such looping.

In another embodiment any of the flexible sheets disclosed herein may be folded on itself in an opposite direction to that previously described so that the interlocking tab projects into and interiorly of the resulting upright structure. Such an upright structure is emplaceable entirely within a flexible bag to protect the bag from tearing, e.g. as it is filled. In one aspect such an embodiment is employed e.g. with branches, limbs, and/or brush so they do not puncture or rip the bag as they are inserted into the upright structure within the bag. In one aspect such embodiments have one or more bag anchors projecting interiorly of the upright structure.

Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A support for a flexible bag, the support comprising a flexible sheet member having a horizontally extending top side, a horizontally extending bottom side spaced apart from the top side, a vertically extending left side, a vertically extending right side spaced apart from the left side, the right side having a first end and the left side having a second end, an interlocking tab formed of or secured to the first end of the sheet member, an end opening formed in the second end of the sheet member for receiving and holding the tab and through which the interlocking tab is projectable, the sheet member foldable onto itself and the tab insertable into and through the end opening and interlockable therein forming an upright structure for supporting the bag within the upright structure, and a portion of the interlocking tab disposable exteriorly of the upright structure for looping of a bag portion under the interlocking tab exteriorly of the upright structure to hold the bag.

2. The support of claim 1 further comprising at least one bag anchor on the sheet member for holding a portion of the bag.

3. The support of claim 2 further comprising the at least one bag anchor is a plurality of bag anchors spaced apart around the sheet member.

4. The support of claim 2 wherein each of the at least one bag anchor is flush with the flexible sheet member and has a corresponding recess therearound for facilitating emplacement of a bag portion around the bag anchor.

5. The support of claim 2 wherein each of the one or more bag anchors comprises an anchor member disposed in an opening in the sheet member, the anchor member spaced apart from an edge defining the opening.

6. The support of claim 2 further comprising a flexible bag supported within the upright structure, at least one bag anchor on the sheet member for holding a portion of the flexible bag, the at least one bag anchor projecting exteriorly of the upright structure, and the portion of the flexible bag looped under the at least one bag anchor exteriorly of the upright structure.

7. The support of claim 1 wherein upon folding of the sheet member on itself a generally cylindrical structure is formed.

8. The support of claim 1 wherein the interlocking tab extends vertically, and the end opening extends vertically corresponding to the interlocking tab.

9. The support of claim 8 further comprising a horizontally extending locking tab, and a latch opening for receiving and releasably holding the horizontally extending locking tab.

10. The support of claim 1 wherein the portion of the interlocking tab extending from the structure does not move in the upright structure for receiving and holding a portion of the bag.

11. The support of claim 1 including a flexible bag supported within the upright structure with at least one portion thereof held exteriorly of the structure by and under the interlocking tab.

12. A supported flexible container comprising a flexible sheet member having a horizontally extending top side, a horizontally extending bottom side spaced apart from the top side, a vertically extending left side, a vertically extending right side spaced apart from the left side, the right side having a first end and the left side having a second end, an interlocking tab extending vertically and formed of or secured to the first end of the sheet member, an end opening extending vertically and formed in the second end of the sheet member for receiving and holding the tab and through which the interlocking tab projects exteriorly of the flexible sheet member, the sheet member foldable onto itself and the tab insertable into the end opening and interlockable therein forming an upright structure for supporting the bag within the upright structure, the interlocking tab disposed exteriorly of the upright structure for looping of a bag portion under the interlocking tab exteriorly of the upright structure to hold the bag, at least one bag anchor on the sheet member for holding a portion of the bag, a flexible bag supported within the upright structure with at least one portion thereof held exteriorly of the structure by and under the interlocking tab, the at least one bag anchor projecting exteriorly of the upright structure, a portion of the flexible bag looped under the at least one bag anchor exteriorly of the upright structure, a horizontally extending locking tab, and a latch opening for receiving and releasably holding the horizontally extending locking tab.

* * * * *